US008496038B2

(12) United States Patent
Kondash et al.

(10) Patent No.: US 8,496,038 B2
(45) Date of Patent: Jul. 30, 2013

(54) SLIDING DOOR WITH ANTI-SWAY TROLLEY ASSEMBLY

(75) Inventors: Joseph Kondash, Wilkes-Barre, PA (US); Joseph Balay, Sugarloaf, PA (US)

(73) Assignee: CIW Enterprises, Inc., Mountaintop, PA (US)

( * ) Notice: Subject to any disclaimer, the term of this patent is extended or adjusted under 35 U.S.C. 154(b) by 824 days.

(21) Appl. No.: 12/476,510

(22) Filed: Jun. 2, 2009

(65) Prior Publication Data

US 2010/0299871 A1 Dec. 2, 2010
US 2012/0240352 A9 Sep. 27, 2012

Related U.S. Application Data

(63) Continuation-in-part of application No. 12/203,718, filed on Sep. 3, 2008, now Pat. No. 8,127,494.

(51) Int. Cl.
*A47H 5/00* (2006.01)

(52) U.S. Cl.
USPC ..... 160/84.08; 16/91

(58) Field of Classification Search
USPC ..... 16/91, 99, DIG. 31, 100, 105, 102, 16/87 R, 87.6 R, 94 D, 93 D, 33, 34; 160/196.1, 160/199, 206, 84.08, 84.09, 84.11; 211/162
See application file for complete search history.

(56) References Cited

U.S. PATENT DOCUMENTS

| | | | | |
|---|---|---|---|---|
| 684,130 | A | | 10/1901 | Taubert |
| 1,377,626 | A | | 5/1921 | Phillips |
| 1,448,845 | A | | 3/1923 | Johnson et al. |
| 1,463,347 | A | * | 7/1923 | Walker ..... 160/206 |
| 1,612,443 | A | | 12/1926 | Johnson et al. |
| 1,644,285 | A | | 10/1927 | Smith |
| 1,786,505 | A | | 12/1930 | Phillips |
| 1,833,496 | A | * | 11/1931 | Phillips ..... 160/113 |
| 1,964,316 | A | | 6/1934 | Ellison |
| 2,151,033 | A | | 3/1939 | Jones |
| 3,102,581 | A | | 9/1963 | Kochanowski |
| 3,295,257 | A | * | 1/1967 | Douglass ..... 49/317 |
| 3,850,223 | A | * | 11/1974 | Tompkins ..... 160/84.08 |
| 4,154,280 | A | * | 5/1979 | Hashimoto ..... 160/84.11 |
| 5,025,846 | A | * | 6/1991 | West ..... 160/199 |
| 5,065,807 | A | | 11/1991 | Maeda et al. |
| 5,143,137 | A | * | 9/1992 | West ..... 160/199 |
| 5,373,887 | A | | 12/1994 | Glover |
| 6,098,695 | A | * | 8/2000 | Schwingle ..... 160/199 |
| 6,286,258 | B1 | | 9/2001 | Bischof et al. |
| 6,892,784 | B2 | | 5/2005 | Maas |

(Continued)

FOREIGN PATENT DOCUMENTS

| | | |
|---|---|---|
| JP | 07317422 | 5/1995 |
| JP | 07317423 | 5/1995 |

*Primary Examiner* — Victor Batson
*Assistant Examiner* — Matthew Sullivan
(74) *Attorney, Agent, or Firm* — Mitchell A. Smolow

(57) ABSTRACT

The present invention provides at least one anti-sway trolley assembly used in conjunction with either a single sided partition set or sandwiched between first and second partition side in a double sided partition set. The anti-sway trolley assembly comprises a floating rod affixed at a first end to a trolley. Affixed at a rod second end is a floor contact member which provides frictional resistance to lateral displacement of the door. Each anti-sway trolley assembly rides in a chain guide and is affixed to a partition hinge rod. In this manner, a floor channel is not required to achieve resistance to lateral displacement forces.

19 Claims, 10 Drawing Sheets

U.S. PATENT DOCUMENTS 7,647,729 B2 * 1/2010 Polus ..... 49/425
7,699,089 B2 * 4/2010 Knutson et al. ..... 160/199
7,886,804 B2 * 2/2011 Goodman et al. ..... 160/199
2007/0272370 A1 * 11/2007 Knutson et al. ..... 160/199

* cited by examiner

SLIDING DOOR WITH ANTI-SWAY TROLLEY ASSEMBLY

CROSS REFERENCE TO RELATED APPLICATIONS

This application is a continuation-in-part and claims benefit of U.S. application Ser. No. 12/203,718 filed Sep. 3, 2008, now U.S. Pat. No. 8,127,494, issued Mar. 6, 2012.

FIELD OF THE INVENTION

This invention relates generally to sliding doors and in particular, to an anti-sway trolley assembly used with side folding accordion partitions.

BACKGROUND OF THE INVENTION

Side folding accordion partitions are used to provide space separation, often with the additional goal of providing one or more of security separation, sound control, and prevention of the spread of fire and smoke.

Panels which form the partition are attached to ball bearing rollers which ride within a mounted overhead track. A lead panel is attached to a lead post which in turn is attached to a trolley having ball bearing rollers which also rides within the overhead track. A powered looped chain is attached to the trolley, thereby providing the mechanical action required to open and close the partition.

When the partition is activated, the ball bearing rollers and lead post trolley roll in the overhead track causing the partitions to traverse open or closed. The partitions may or may not be slidably mounted to a floor channel. Partitions slidably mounted to a floor channel ensure that the partitions remain in the vertical thereby keeping the sweep at the bottom of the partition in contact with the floor. The floor channel provides lateral stability to the door curtain during travel towards or away from the closed position.

However, certain applications require a contiguous floor surface, i.e., unbroken by a floor channel, for example, shop floors where a channel could interfere with rolling carts, or emergency egress lanes where a floor channel could create a tripping hazard. In those situations, door assemblies that do not mount the partitions to a floor channel are utilized. These partitions are prone to translating from the vertical, preventing the sweep at the bottom of the partition from maintaining a predetermined relationship to the floor, thereby, for example, allowing smoke to pass underneath the partition.

Known designs do not prevent translation of the partition from the vertical when using folding accordion partitions without a floor channel. Accordingly, there is still a continuing need for improved sliding door design, and in particular, for maintaining partition verticality and sweep floor contact when using folding accordion partition designs without a floor channel. The present invention fulfills this need by presenting a novel anti-sway trolley assembly and further provides related advantages.

BRIEF SUMMARY OF THE INVENTION

The present invention provides at least one anti-sway trolley assembly used in conjunction with either a single sided partition set or preferably sandwiched between an inner and outer partition in a double sided partition set. The anti-sway trolley assembly comprises a floating rod assembly affixed at a first end to a trolley. Affixed at a rod assembly second end is a floor contact member which provides frictional resistance to lateral displacement of the door. Each anti-sway trolley assembly rides in a chain guide and is affixed to a partition hinge. In this manner, a floor channel is not required to achieve resistance to lateral displacement forces.

BRIEF DESCRIPTION OF THE DRAWINGS

The accompanying drawings are included to provide a further understanding of the present invention. These drawings are incorporated in and constitute a part of this specification, illustrate one or more embodiments of the present invention, and together with the description, serve to explain the principles of the present invention.

Other features and advantages of the present invention will be apparent from the following more detailed description of the preferred embodiments, taken in conjunction with the accompanying drawings which illustrate, by way of example, the principles of the invention.

DETAILED DESCRIPTION OF THE INVENTION

As required, detailed embodiments of the present invention are disclosed; however, it should be understood that the disclosed embodiments are merely exemplary of the invention that may be embodied in various forms. The figures are not necessarily to scale, and some features may be exaggerated to show details of particular components. Therefore, specific structural and functional details disclosed are not to be interpreted as limiting, but merely as a basis for the claims and as a representative basis for teaching one skilled in the art to variously employ the present invention.

Figure 1:
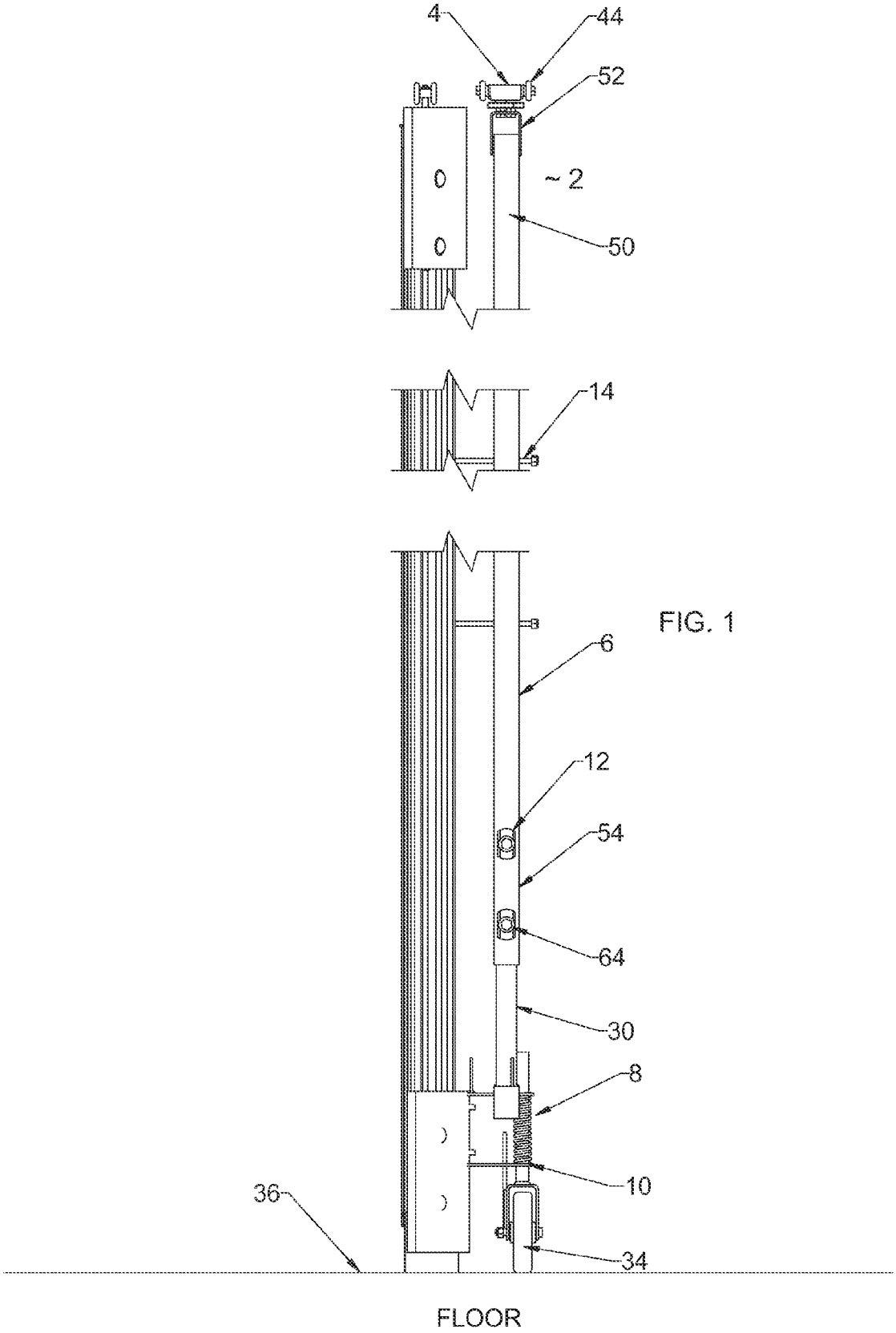
FIG. 1 is a side view of the sliding door of the present invention.
Figure 2:
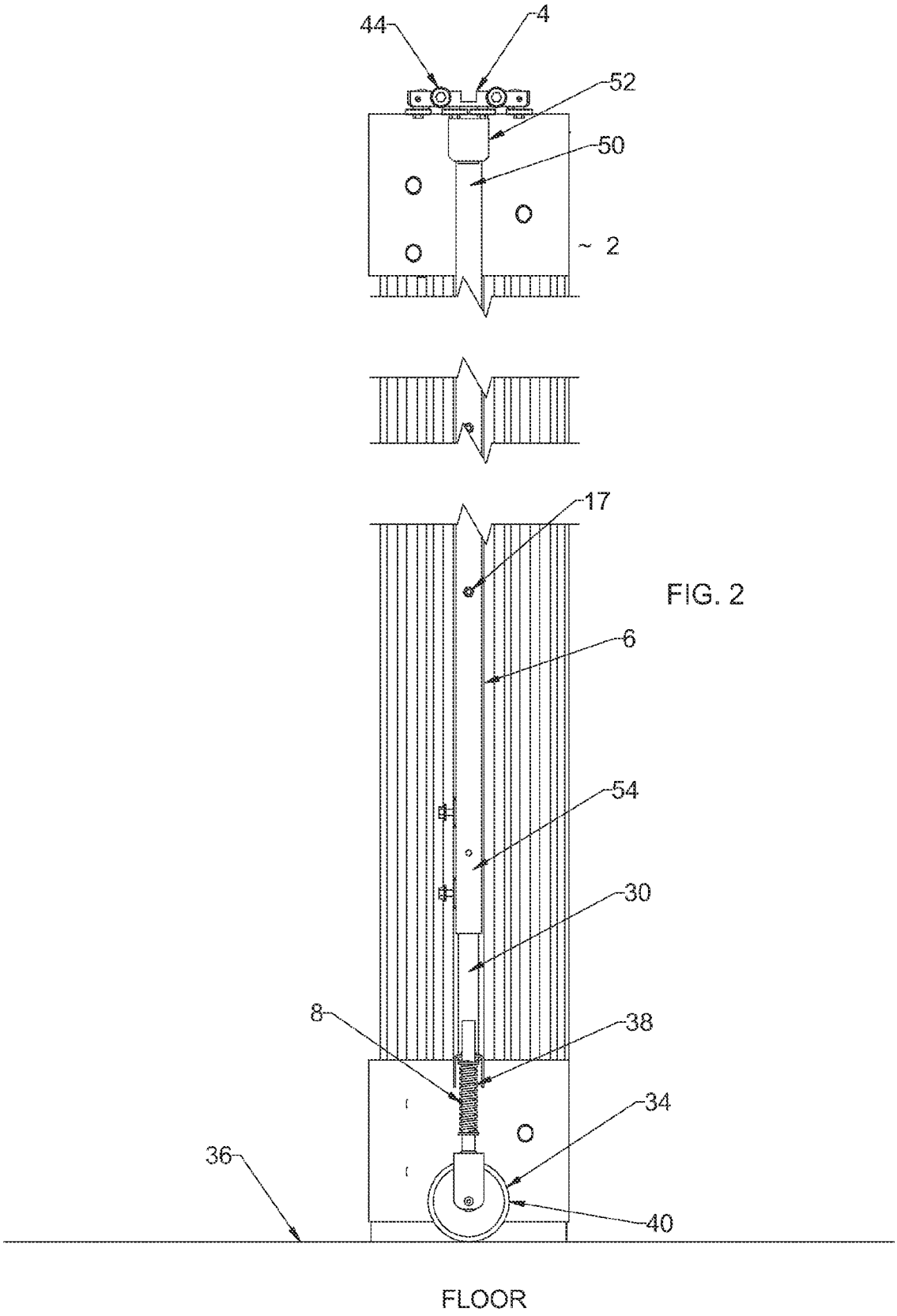
FIG. 2 is a front view of a section of the sliding door of the present invention.
Figure 3:
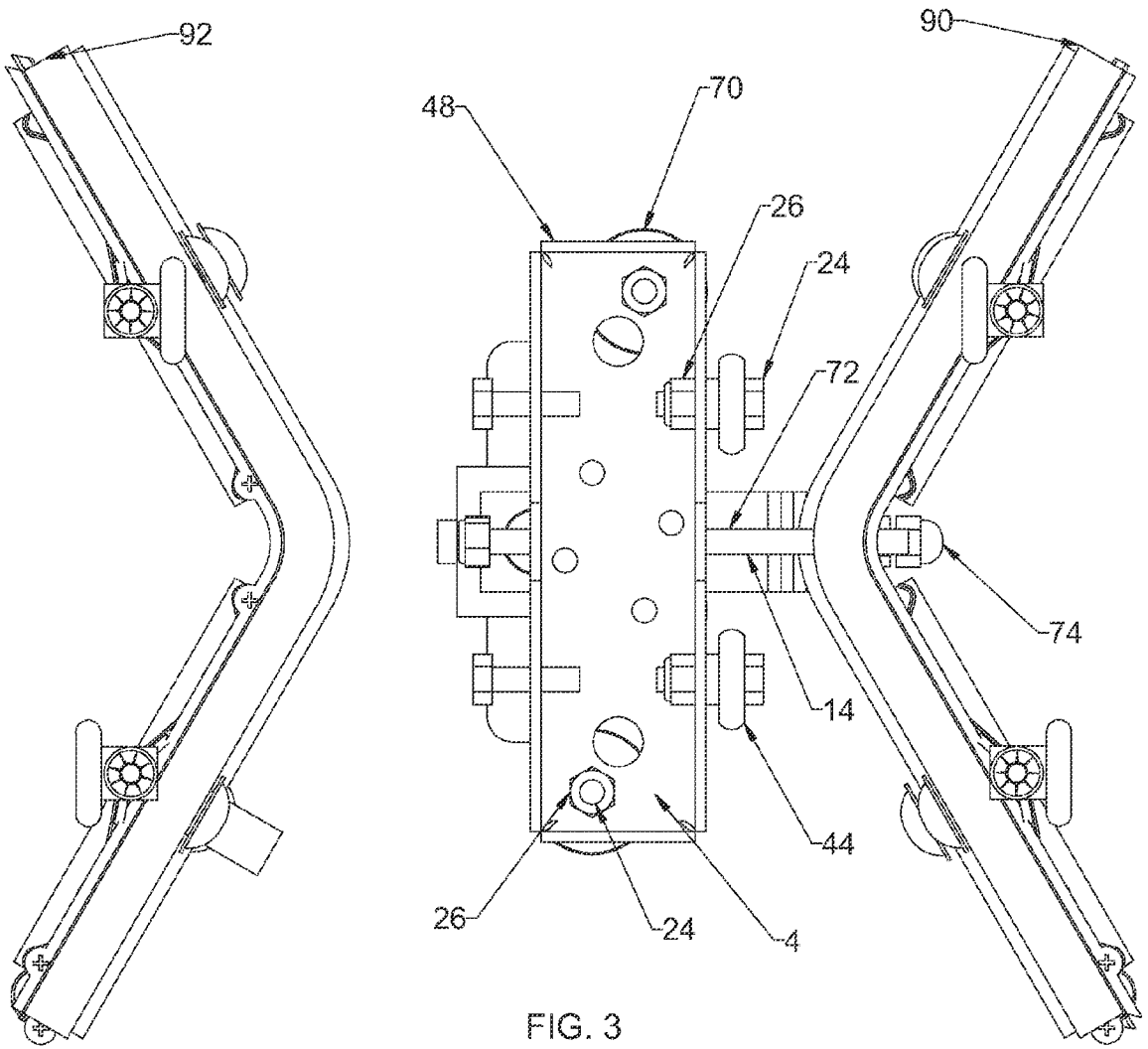
FIG. 3 is a is a top view of an anti-sway trolley assembly, first partition side and second partition side.

Turning now to FIGS. 1-3, anti-sway trolley assembly 2 comprises anti-sway trolley 4, floating rod assembly 6 and bottom assembly 8.

Figure 7:
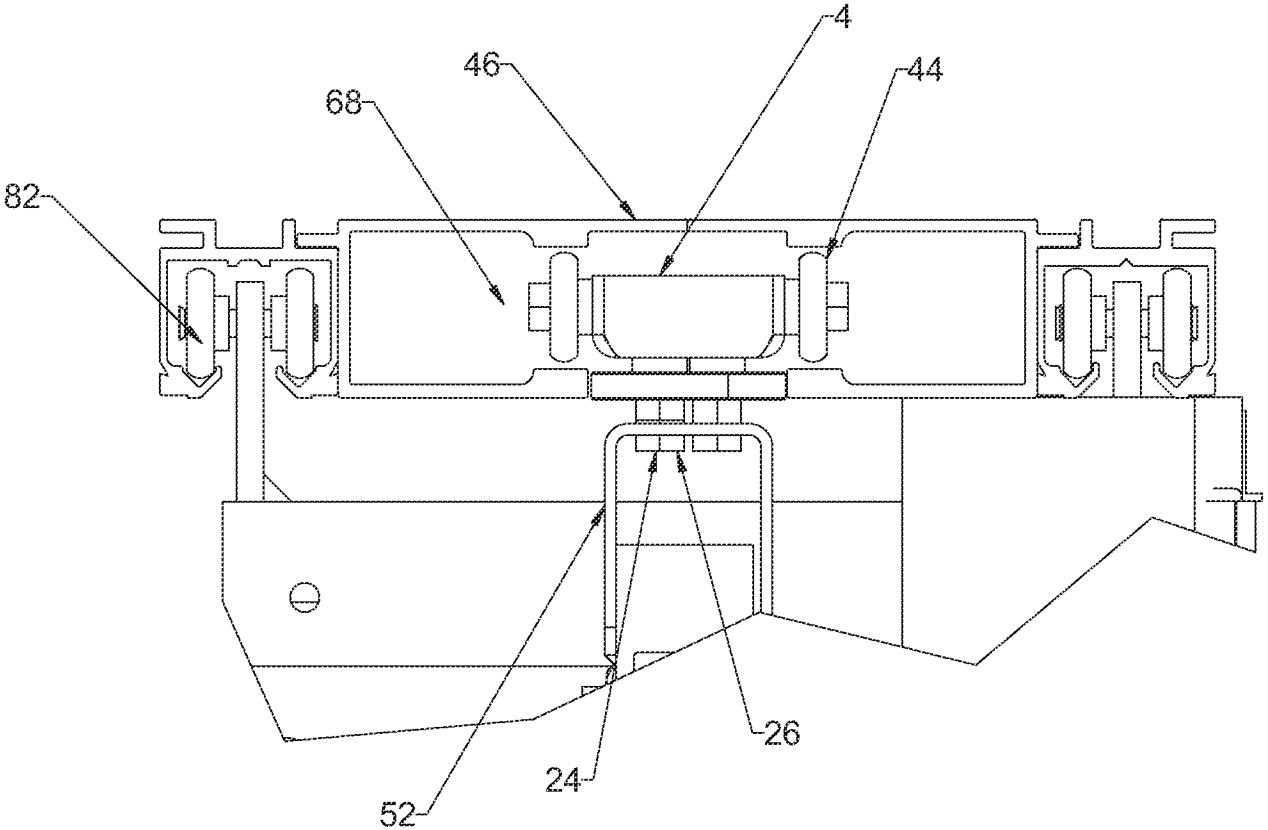
FIG. 7 is a cross sectional view of an anti-sway trolley assembly engaged in a chain guide.
Figure 8:
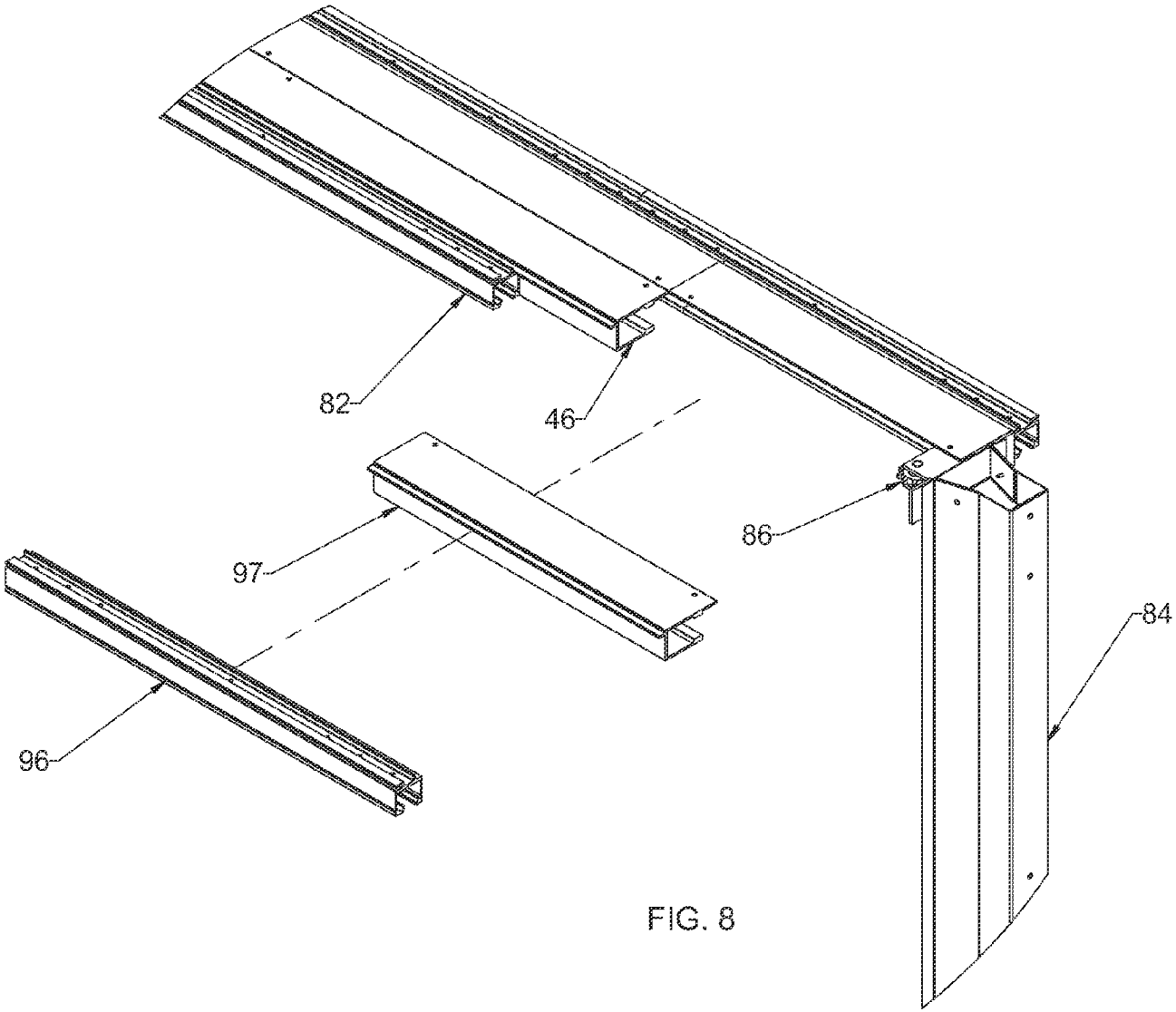
FIG. 8 is a perspective view showing a removed load section.

Anti-sway trolley 4 comprises a plurality of trolley rollers 44, preferably ball bearing rollers, which engage chain guide 46 at inner channel 68 as shown in FIG. 7. Chain guide 46 and track 82 are mounted to a door opening. Trolley rollers 44 are mounted to trolley body 48 using, for example, bolt 24 and nut 26. A portion of trolley body 48 is fabricated to receive floating rod first end 50. In a preferred embodiment, floating rod first end receiving member 52 is affixed, for example, crimped, bolted or spot welded, to trolley body 48 to receive floating rod first end 50.

Figure 4:
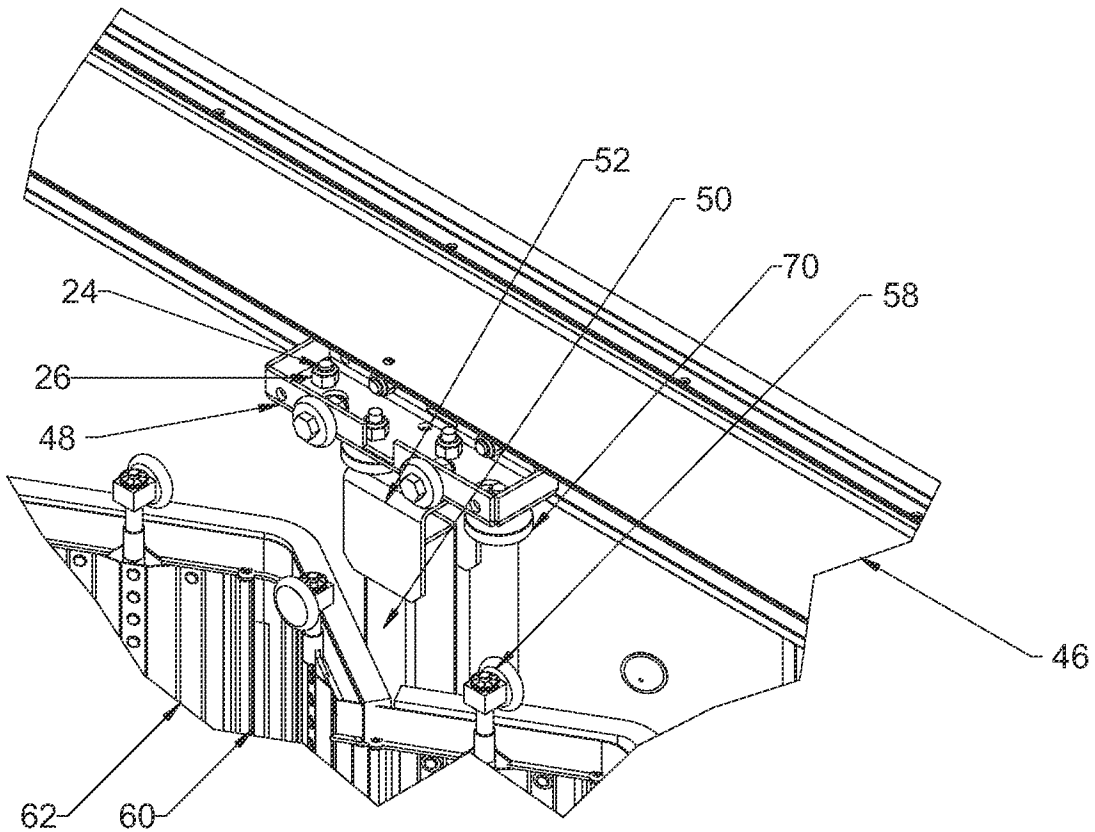
FIG. 4 is a cut-away perspective view of the anti-sway trolley.

As shown in FIG. 4, horizontal bearings 70 are mounted to underside of trolley body 48 using bolt 24 and nut 26 (FIG. 3). Horizontal bearings 70 are of sufficient diameter so as to extend beyond side of trolley body 48 to engage side walls of track chain guide 46, thereby helping to center the anti-sway trolley assembly 4 within chain guide 46.

Returning to FIGS. 1 and 2, floating rod assembly 6 comprises down member 10, preferably a hollow tube or bar. Floating rod assembly first end 50 is received by floating rod assembly first end receiving member 52, described above. In a preferred embodiment, floating rod assembly first end receiving member 52 is, for example, a U shaped bracket. U shaped bracket receiving member 52 is affixed to floating rod assembly first end 50 for example, with a press fit, weld, or one or more bolt and nut.

A plurality of hinges 60 (FIG. 4) are mounted to panels 62. Each panel 62 is attached to roller 58 at its upper end. Rollers 58 alternate facing inward and outward to engage inner and outer walls of the track 82 outer channel (FIG. 7). At least one panel 62, but preferably a plurality of panels 62, comprises a partition side.

At least one, preferably a plurality of orifices 17, are positioned along the length of floating rod assembly 6 and hinge 60 to receive a connector 14, for example, a bolt 72 and acorn nut 74, to connect floating rod assembly 6 to hinge 60 of a first partitions side 90. (FIG. 3) Preferably, the connectors 14 are spaced about every four feet.

Floating rod assembly second end 54 adjustably receives bottom assembly 8. In a preferred embodiment, lower floating rod assembly first member 30 is slidably received by floating rod second end 54. Floating rod second end 54 contains orifices 12 to lock lower floating rod assembly first member 30 into position using fastener 64 to maintain the lower floating rod assembly first member 30-floating rod assembly second end 54 relationship.

Bottom assembly 8 is adjustably attached to lower floating rod assembly first member 30 so as to urge floor contact member 34 to remain in contact with the floor 36 thereby providing frictional lateral displacement resistance. In a preferred embodiment, spring 38 is loaded by lower floating rod assembly first member 30 and floor contact member 34 is a caster 40. While the preferred embodiment utilizes a caster 40, it should be appreciated that any floor contact member resistant to lateral displacement is acceptable, for example, a ribbed pad wherein the ribs are parallel to the partition sliding direction.

Figure 9:
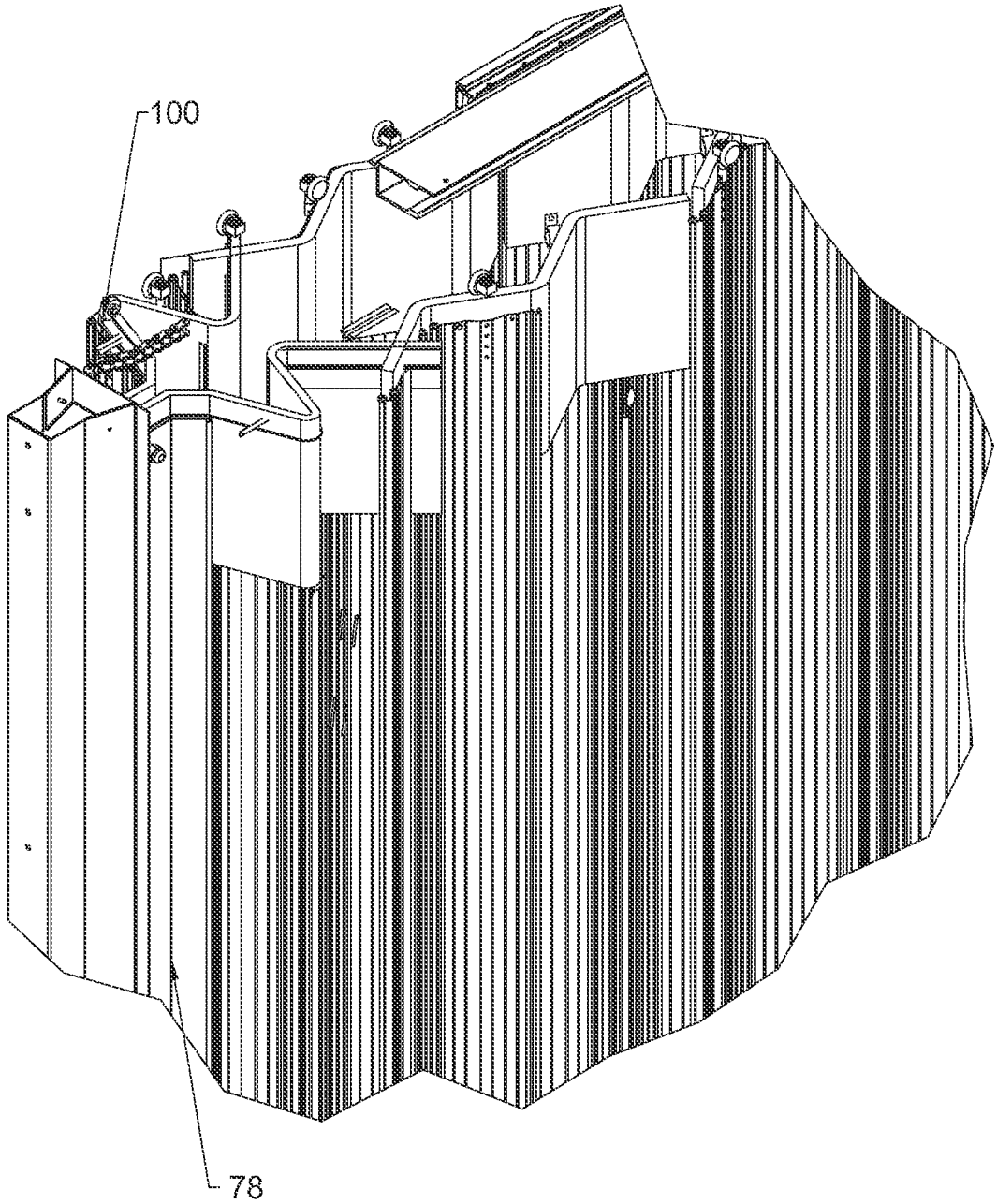
FIG. 9 is a cut-away perspective view of a double sided partition set.

Turning to FIGS. 5, 6, 8, 9 and 10, door lead trolley assembly 100 rides within track 82 and chain guide 46 mounted to a door opening in conventional manner. Door lead trolley assembly 100 receives lead post 78 (FIG. 9).

Track 82 and striker 84 (FIG. 8) are mounted in conventional manner. Utilizing known removed track and chain guide load section, door lead trolley assembly 100, anti-sway trolley assembly and panels 62 are translationally engaged into track 82 and chain guide 46. Panels 62 are mounted to lead post 78 in conventional manner. Floating rod assembly 6 is translationally engaged into chain guide 46 as described above. Known removed load section, track 96, and chain guide 97 also allows for ease of removal of component parts as necessary for servicing. Removable load section technology is well known and will not be described in further detail.

Figure 5:
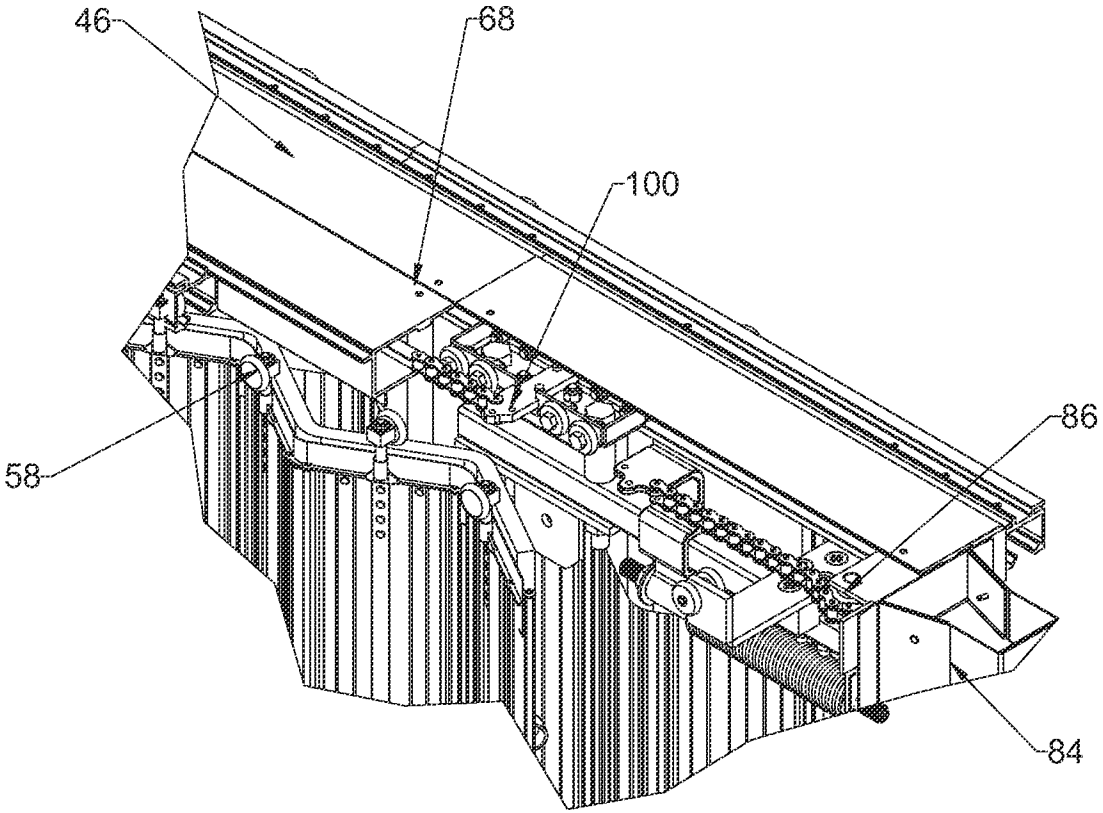
FIG. 5 is a cut-away perspective view of a partition/track arrangement.
Figure 6:
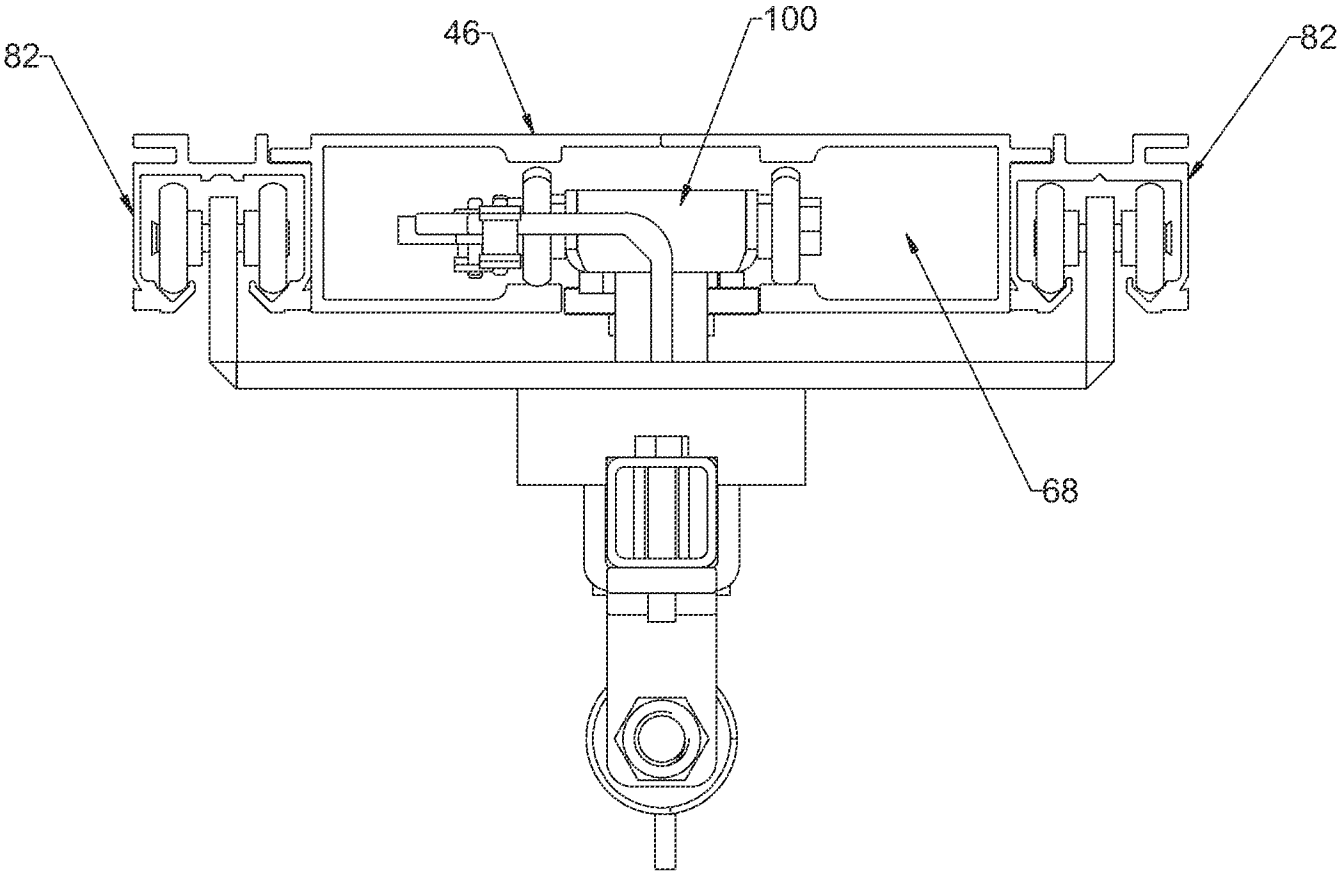
FIG. 6 is a cross sectional view of a lead post trolley engaged in a track.

Referring to FIG. 5, chain pulley 86 is mounted within chain guide 46 in conventional manner. Chain is thereafter looped around chain pulley 86 and conventional power sprocket (not shown) remotely located from chain pulley 86 and attached to door lead trolley assembly 100 in conventional manner.

The floor contact member 34 maintains continuous predetermined tension against the floor. In a preferred embodiment, as the door is activated, the anti-sway trolley assembly 2 rolls in the chain guide 46 with the spring 38 loaded caster 34 continually urged in contact with the floor 36, thereby providing both lateral stability to the door panels 62 during travel towards or away from the closed position and ensuring that the sweep at the bottom of the door maintains a predetermined position with respect to the floor 36.

Preferably, the anti-sway trolley assemblies 2 are located about every 3 to about every 4 feet along the span of the door and more preferably about every 3.5 feet along the span of the door.

The preferred embodiment uses a double sided partition. As exemplified in FIG. 3, the panels 62 of the first partition side 90 are mounted to floating rod assemblies 6 as described above. The panels 62 of the second partitions side 92 are not mounted to floating rod assemblies 6. The panels 62 of both partition sides 90, 92 are hung by rollers 58 in track 82 outer channel (FIG. 7) in known manner, for example, as described above. The panels 62 of the second partition side 92 ride "free" of the floating rod assemblies. The lead panel of both partition sides, 90, 92 are attached to lead post 78 in conventional fashion to obtain operative movement of both partition sides 90, 92. It should be apparent that if a single sided partition is desired, free riding second partition side 92 is simply omitted.

Figure 10:
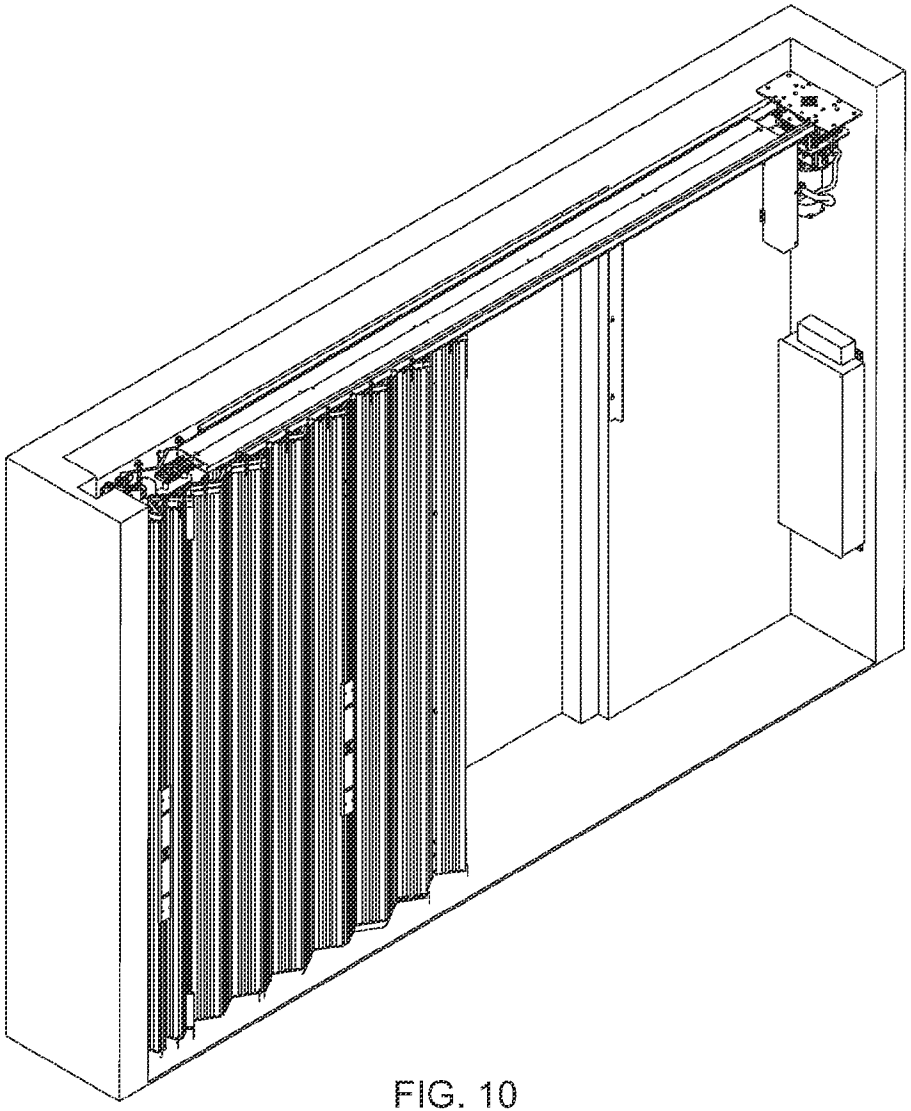
FIG. 10 is a perspective view of a sliding partition within a door opening.

FIG. 10 exemplifies a hinged sliding partition within a door opening.

Although the present invention has been described in connection with specific examples and embodiments, those skilled in the art will recognize that the present invention is capable of other variations and modifications within its scope. These examples and embodiments are intended as typical of, rather than in any way limiting on, the scope of the present invention as presented in the appended claims.

What is claimed is:

1. An anti-sway trolley assembly comprising:

a trolley translationally engaging a guide mounted to a door opening, the trolley affixed to a floating rod at a first end;

a hinging partition translationally engaged to the guide comprising a first partition side; the floating rod affixed to the first partition side at a hinge; and a bottom assembly affixed to the floating rod at a second end;

wherein the bottom assembly comprises a first member attached to the floating rod second end and a second member urgedly attached to the first member, the second member urging a floor contact member; the guide comprises a track and a chain guide; the hinging partition translationally engages the track and the trolley translationally engages the chain guide.

2. The anti-sway trolley assembly of claim 1 wherein the trolley comprises a plurality of rollers mounted to a frame engaging a guide inner channel; a bearing mounted to the underside of the frame, the bearing extending beyond a frame side engaging a side wall of the guide inner channel; and a receiving member receiving the floating rod first end.

3. The anti-sway trolley assembly of claim 1 further comprising a spring positioned between the first and second member urging the floor contact member.

4. The anti-sway trolley assembly of claim 1 wherein the partition further comprises a second partition side; the floating rod positioned between the first and second partition sides and affixed to the first partition side; the second partition side free of the floating rod.

5. A hinging partition apparatus comprising:

a track and a chain guide mounted to a door opening;

a chain pulley receiving a powered loop of chain;

a hinging partition translationally engaged to the track;

a lead trolley assembly adapted for translational movement and attachment to a lead partition;

the powered loop of chain operatively connecting the chain pulley and lead trolley assembly; and an anti-sway trolley assembly adapted for translational movement within the chain guide, wherein the anti-sway trolley assembly comprises an anti-sway trolley translationally engaging the chain guide, the trolley affixed to a floating rod at a floating rod first end; and a bottom assembly affixed to the floating rod at a floating rod second end; wherein the bottom assembly comprises an urged floor contact member and the floating rod is affixed to the hinging partition at a hinge; the hinging partition comprising a first partition side; the floating rod affixed to the first partition side.

6. The hinging partition apparatus of claim 5 wherein the anti-sway trolley comprises a plurality of rollers mounted to a frame engaging a track chain guide inner channel; a bearing mounted to the underside of the frame, the bearing extending beyond a frame side engaging a side wall of the chain guide inner channel; and a receiving member receiving the floating rod first end; and the bottom assembly comprises a first member attached to the floating rod second end and a second member urgedly attached to the first member urging the floor contact member.

7. The hinging partition apparatus of claim 6 further comprising a spring positioned between the first and second member.

8. The hinging partition apparatus of claim 7 wherein the floor contact member is a caster.

9. The hinging partition apparatus of claim 6 wherein a plurality of anti-sway trolley assemblies are located about every 3 to about every 4 feet along the hinging partition.

10. The hinging partition apparatus of claim 6 wherein a plurality of anti-sway trolley assemblies are located about every 3.5 feet along the hinging partition.

11. The hinging partition apparatus of claim 7 wherein the floating rod is affixed to the hinging partition with a bolt and nut.

12. The hinging partition apparatus of claim 5 wherein the hinging partition further comprises a second partition side; the floating rod is positioned between the first and second partition sides and affixed to the first partition side; the second partition side free of the floating rod.

13. A method limiting the movement of a hinging partition lateral to a direction normal to a floor comprising the steps of:

a. installing a guide to a door opening;

b. installing an anti-sway trolley assembly to the guide; and c. installing the hinging partition to the anti-sway trolley assembly and guide;

wherein the anti-sway trolley assembly comprises a trolley translationally engaging the guide, the trolley affixed to a floating rod at a first end;

the hinging partition translationally engaged to the guide comprising a first partition side; the floating rod affixed to the first partition side at a hinge; and a bottom assembly affixed to the floating rod at a second end;

wherein the bottom assembly comprises a first member attached to the floating rod second end and a second member urgedly attached to the first member, the second member urging a floor contact member against the floor; the guide comprises a track and a chain guide; the hinging partition translationally engages the track and the trolley translationally engages the chain guide.

14. The method of claim 13 wherein the trolley comprises a plurality of rollers mounted to a frame engaging a guide inner channel; a bearing mounted to the underside of the frame, the bearing extending beyond a frame side to engage a side wall of the guide inner channel; and a receiving member receiving the floating rod first end.

15. The method of claim 13 further comprising a spring positioned between the first and second member urging the floor contact member against the floor.

16. The method of claim 13 wherein the floating rod is affixed to the partition through a partition hinge rod.

17. The method of claim 13 wherein the wherein the hinging partition further comprises a second partition side; the floating rod is positioned between the first and second partition sides and affixed to the first partition side; the second partition side free of the floating rod.

18. The anti-sway trolley of claim 1 wherein the floating rod is affixed to the partition through a partition hinge rod.

19. The hinging partition apparatus of claim 5 wherein the floating rod is affixed to the partition through a partition hinge rod.

* * * * *